US010821054B1

(12) United States Patent
Howton et al.

(10) Patent No.: US 10,821,054 B1
(45) Date of Patent: Nov. 3, 2020

(54) AUTOMATED PILL DISPENSER

(71) Applicants: Victoria Howton, Valencia, CA (US); Jeffrey Howton, Valencia, CA (US); Brian Rose, Valencia, CA (US)

(72) Inventors: Victoria Howton, Valencia, CA (US); Jeffrey Howton, Valencia, CA (US); Brian Rose, Valencia, CA (US)

( * ) Notice: Subject to any disclaimer, the term of this patent is extended or adjusted under 35 U.S.C. 154(b) by 217 days.

(21) Appl. No.: 16/121,710

(22) Filed: Sep. 5, 2018

(51) Int. Cl.

| | |
|---|---|
| ***A61J 7/04*** | (2006.01) |
| ***A61J 7/02*** | (2006.01) |
| ***A61J 7/00*** | (2006.01) |
| ***G07F 11/18*** | (2006.01) |
| ***G07F 17/00*** | (2006.01) |
| ***G07F 11/44*** | (2006.01) |

(52) U.S. Cl.
CPC ..... *A61J 7/0481* (2013.01); *A61J 7/02* (2013.01); *A61J 7/0084* (2013.01); *A61J 7/0454* (2015.05); *G07F 11/18* (2013.01); *G07F 11/44* (2013.01); *G07F 17/0092* (2013.01)

(58) Field of Classification Search
CPC ..... A61J 7/0481; A61J 7/02; A61J 7/0454; A61J 7/0084; G07F 11/18; G07F 17/0092; G07F 11/44
USPC ..... 700/231–244
See application file for complete search history.

(56) References Cited

U.S. PATENT DOCUMENTS

| | | | | |
|---|---|---|---|---|
| 6,208,911 | B1 * | 3/2001 | Yamaoka | G07F 17/0092 700/242 |
| 6,330,957 | B1 | 12/2001 | Bell-Greenstreet | |
| 6,622,887 | B1 | 9/2003 | Roediger | |
| 7,048,141 | B2 | 5/2006 | Abdulhay | |
| 7,269,476 | B2 | 9/2007 | Ratnakar | |
| 8,670,865 | B2 * | 3/2014 | Coe | A61J 7/0481 700/243 |
| D715,638 | S | 10/2014 | Wollschleger | |
| 9,245,093 | B2 * | 1/2016 | Shaw | G06F 19/3462 |
| 9,889,069 | B1 * | 2/2018 | Coe | H04W 4/70 |
| 10,010,484 | B2 * | 7/2018 | Muller | B26D 3/30 |
| 10,335,349 | B2 * | 7/2019 | Roslyakov | A61J 7/0076 |
| 2003/0183642 | A1 | 10/2003 | Kempker | |
| 2007/0185615 | A1 * | 8/2007 | Bossi | G07F 17/0092 700/244 |
| 2009/0281657 | A1 * | 11/2009 | Gak | G07F 17/0092 700/242 |
| 2011/0093207 | A1 * | 4/2011 | Ingber | G01N 35/025 702/19 |

(Continued)

FOREIGN PATENT DOCUMENTS

WO 2009137025 11/2009

*Primary Examiner* — Michael Collins

(57) ABSTRACT

The automatic pill dispenser is a timing device. The automatic pill dispenser is configured for use with one or more prescription vials. Each of the one or more prescription vials contains a pharmacologically active media. The pharmacologically active media is maintained as a tablet. The automatic pill dispenser comprises a cabinet, a turntable, a storage rack, a dispensing station, a dispensing drawer, and a control system. The control system manages and regulates the operation of the automatic pill dispenser. The turntable and the storage rack stores the one or more prescription vials. The dispensing station and the dispensing drawer count and dispenses one or more doses of pharmacologically active media that are required by a patient.

15 Claims, 15 Drawing Sheets

(56) References Cited

U.S. PATENT DOCUMENTS

| | | | | |
|---|---|---|---|---|
| 2014/0114469 | A1* | 4/2014 | Givens | B67D 1/0041 700/232 |
| 2014/0310018 | A1* | 10/2014 | Cizmarik | A61J 7/0084 705/2 |
| 2015/0217930 | A1* | 8/2015 | Holmes | G07F 11/54 221/1 |
| 2017/0270274 | A1* | 9/2017 | Garcia | G07F 11/54 |
| 2018/0055738 | A1* | 3/2018 | Chen | G16H 40/67 |
| 2018/0060525 | A1* | 3/2018 | Chen | B65B 35/405 |
| 2018/0064609 | A1* | 3/2018 | Hines | A61J 7/0418 |
| 2019/0307647 | A1* | 10/2019 | Greenspan | A61B 5/4833 |

* cited by examiner

AUTOMATED PILL DISPENSER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of instruments and digital computing, more specifically, a computed distribution device that properly distributes doses of medication to a patient.

SUMMARY OF INVENTION

The automatic pill dispenser is a timing device. The automatic pill dispenser is configured for use with one or more prescription vials. Each of the one or more prescription vials contains a pharmacologically active media. The pharmacologically active media is maintained in a form selected from the group consisting of a tablet and a capsule. This disclosure hereinafter incorporates a pharmacologically active media in a capsule form into the term tablet. The pharmacologically active media is contained within a prescription vial selected from the one or more prescription vials. The automatic pill dispenser: a) maintains a database regarding each of the plurality of prescription vials; b) calculates and measures the time between doses of any two pharmacologically active media contained in any two prescription vials selected from the one or more prescription vials; c) generates an alarm when a dose of a pharmacologically active media selected from the one or more prescription vials is due to be consumed by the patient; d) counts out the one or more tablets necessary to provide the dose; and, e) dispenses the dosage of pharmacologically active media to a patient.

The automatic pill dispenser comprises a cabinet, a turntable, a storage rack, a dispensing station, a dispensing drawer, and a control system. The control system manages and regulates the operation of the automatic pill dispenser. The turntable and the storage rack stores the one or more prescription vials. The dispensing station and the dispensing drawer count and dispenses one or more doses of pharmacologically active media that are required by a patient.

These together with additional objects, features and advantages of the automatic pill dispenser will be readily apparent to those of ordinary skill in the art upon reading the following detailed description of the presently preferred, but nonetheless illustrative, embodiments when taken in conjunction with the accompanying drawings.

In this respect, before explaining the current embodiments of the automatic pill dispenser in detail, it is to be understood that the automatic pill dispenser is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the automatic pill dispenser.

It is therefore important that the claims be regarded as including such equivalent construction insofar as they do not depart from the spirit and scope of the automatic pill dispenser. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
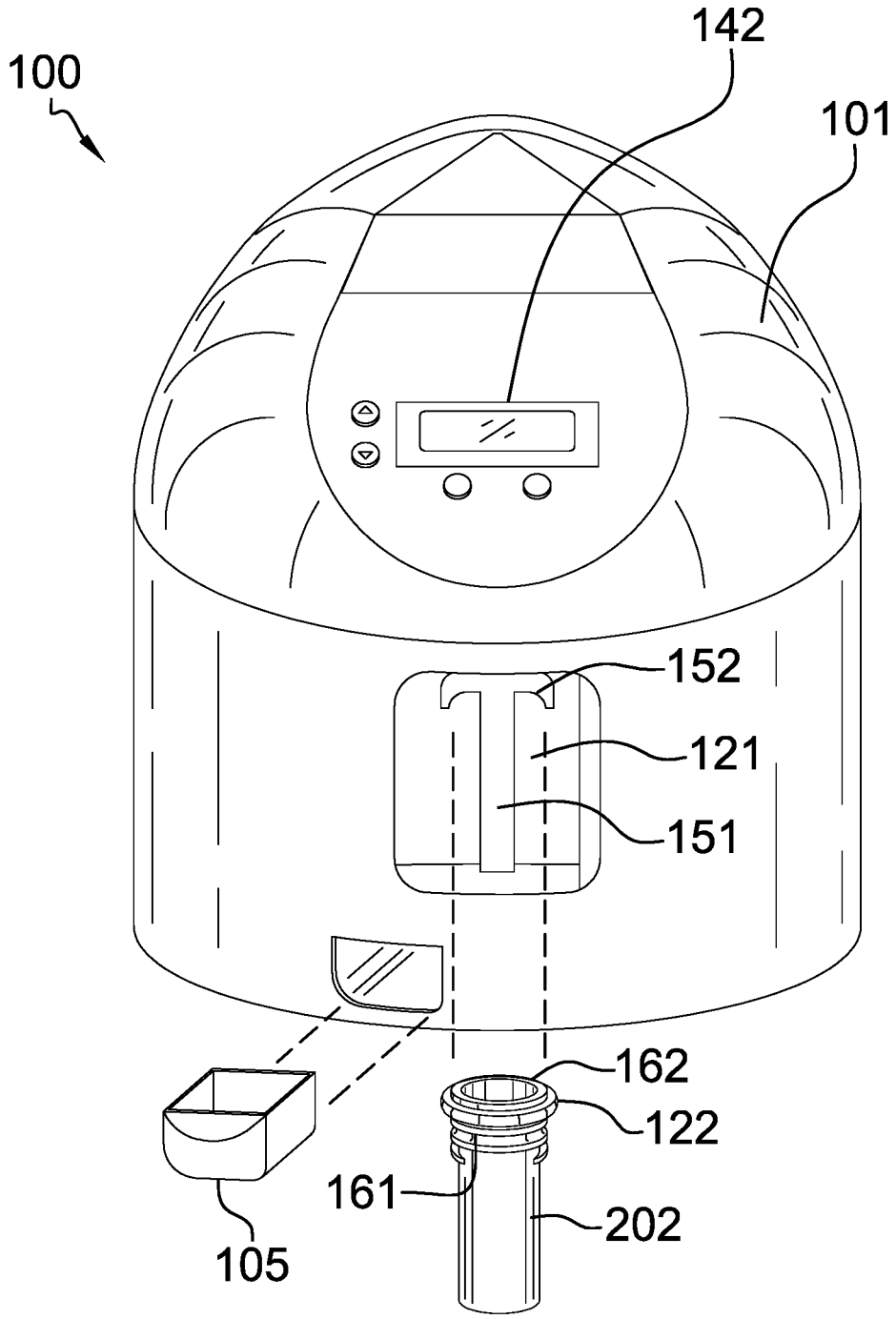
FIG. 1 is a perspective view of an embodiment of the disclosure.
Figure 2:
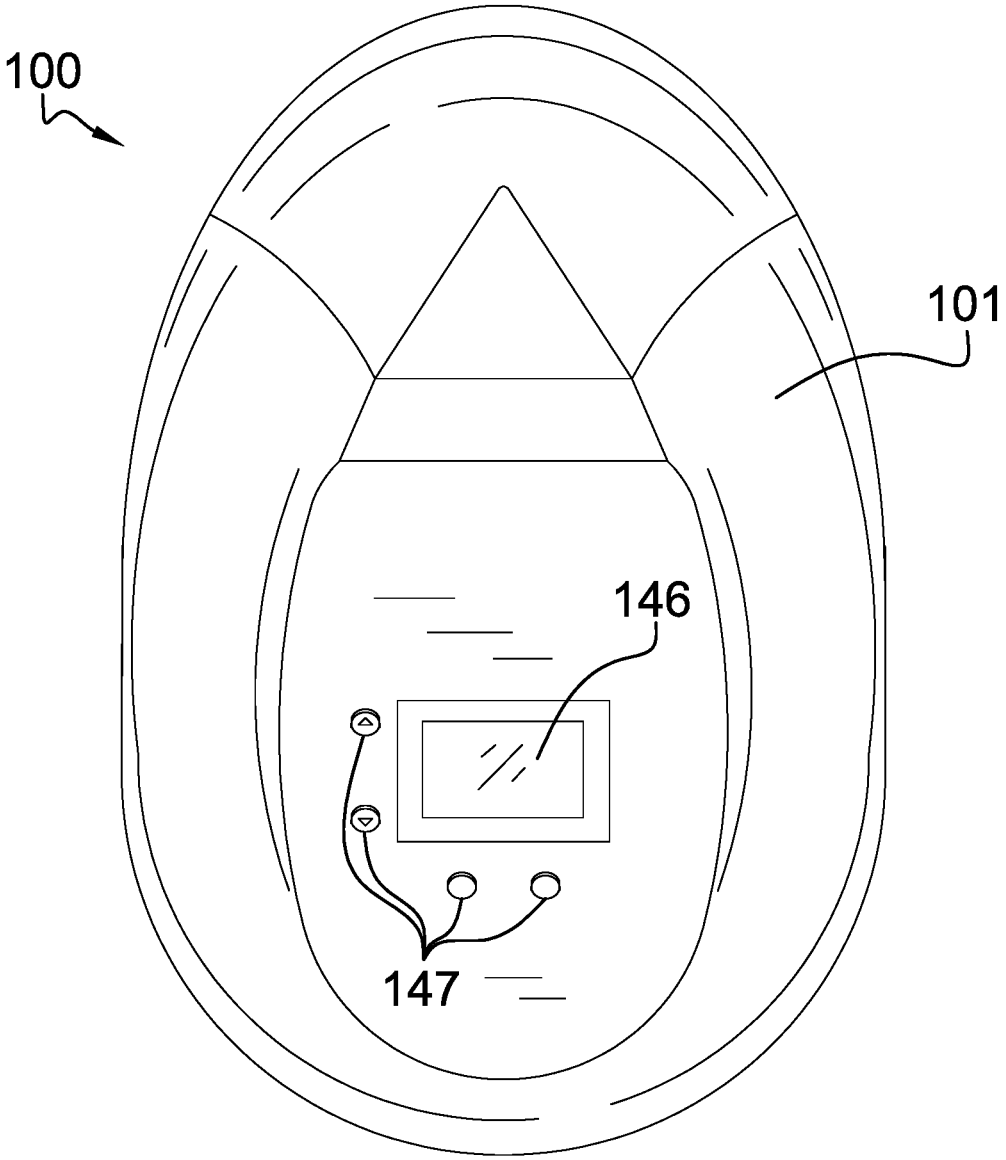
FIG. 2 is a top view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 15.

The automatic pill dispenser 100 (hereinafter invention) is a timing device. The invention 100 is configured for use with one or more prescription vials 202. Each of the one or more prescription vials 202 contains a pharmacologically active media 201. The pharmacologically active media 201 is maintained in a form selected from the group consisting of a tablet 203 and a capsule. This disclosure hereinafter incorporates a pharmacologically active media 201 in a capsule form into the term tablet 203. The pharmacologically active media 201 is contained within a prescription vial selected from the one or more prescription vials 202. The invention 100: a) maintains a database regarding each of the plurality of prescription vials; b) calculates and measures the time between doses of any two pharmacologically active media 201 contained in any two prescription vials selected from the one or more prescription vials 202; c) generates an alarm 145 when a dose of a pharmacologically active media 201 selected from the one or more prescription vials 202 is due to be taken; d) counts out the one or more tablets 203 necessary to provide the dose; and, e) dispenses the dosage of pharmacologically active media 201 to a patient.

The invention 100 comprises a cabinet 101, a turntable 102, a storage rack 103, a dispensing station 104, a dispensing drawer 105, and a control system 106. The control system 106 manages and regulates the operation of the invention 100. The turntable 102 and the storage rack 103 stores the one or more prescription vials 202. The dispensing station 104 and the dispensing drawer 105 count and dispense one or more doses of pharmacologically active media 201 that are required by a patient. The cabinet 101 contains the turntable 102, the storage rack 103, the dispensing station 104, the dispensing drawer 105, and the control system 106.

The cabinet 101 forms the housing of the invention 100. The cabinet 101 is a hollow shell that contains the turntable 102, the storage rack 103, the dispensing station 104, the dispensing drawer 105, and the control system 106. The cabinet 101 is formed with all apertures and form factors necessary to allow the cabinet 101 to accommodate the use and operation of the invention 100. Methods to form a housing suitable for the purposes described in this disclosure are well-known and documented in the mechanical arts.

The turntable 102 is a rotating structure. The turntable 102 forms a rotating horizontal surface upon which the storage rack 103 mounts. The turntable 102 comprises a slewing platform 111, a slewing bearing 112, and a slewing motor 113.

The slewing platform 111 is a disk-shaped horizontal surface. The slewing platform 111 forms a pedestal upon which the storage rack 103 mounts. The slewing bearing 112 is a commercially available slewing bearing 112. The slewing bearing attaches the slewing platform 111 to the inferior surface of the cabinet 101. The slewing motor 113 is an electrical motor. The slewing motor 113 is controlled by the control system 106. The slewing motor 113 rotates the storage rack 103 such that each of the one or more prescription vials 202 stored in the storage rack 103 can be rotated into a position where any prescription vial selected from the one or more prescription vials 202 can be accessed by the dispensing station 104.

The storage rack 103 mounts on the turntable 102 such that the rotation of the turntable 102 changes the position of the storage rack 103 relative to the dispensing station 104. By adjusting the position of the storage rack 103 relative to the dispensing station 104, the turntable 102 allows the dispensing station 104 to access each of the one or more prescription vials 202 in order to dispense the pharmacologically active media 201 contained in the selected prescription vial. The storage rack 103 is a mechanical structure. The storage rack 103 stores the one or more prescription vials 202 such that each of the one or more prescription vials 202 is accessible to the dispensing station 104. The storage rack 103 comprises a plurality of bottle stations 121 and a plurality of lid adapters 122.

Each of the plurality of bottle stations 121 is a mechanical structure that stores a prescription vial selected from the one or more prescription vials 202. Each of the plurality of bottle stations 121 suspends the prescription vial selected from the one or more prescription vials 202 above the slewing platform 111 of the turntable 102. Each of the plurality of bottle stations 121 is identical. Each of the plurality of bottle stations 121 comprises a vial stanchion 151 and a vial clamp 152.

The vial stanchion 151 is a stanchion that projects perpendicularly away from the superior surface of the slewing platform 111 in the manner of a cantilever. The vial stanchion 151 is an extension structure that creates a vertical span of distance between the superior surface of the slewing platform 111 and the vial clamp 152. The vial clamp 152 is a hyoid-shaped structure. The vial clamp 152 attaches to the free end of the vial stanchion 151 such that the selected prescription vial is suspended above the superior surface of the slewing platform 111. The vial clamp 152 is configured to grasp the vial ring 161 of a lid adapter selected from the plurality of lid adapters 122 such that the selected prescription vial associated with the selected lid adapter can be suspended above the slewing platform 111 by the vial stanchion 151.

Each of the plurality of lid adapters 122 is a composite prism structure. Each of the plurality of lid adapters 122 attaches to a prescription vial selected from the one or more prescription vials 202. Each of the plurality of lid adapters 122 attaches to a selected prescription vial such that the selected prescription vial can be suspended from the plurality of bottle stations 121. Each of the plurality of lid adapters attaches to a selected prescription vial such that the selected prescription vial can be accessed and manipulated by the dispensing station 104. Each of the plurality of lid adapters 122 comprises a vial ring 161 and a dispenser ring 162.

The vial ring 161 is a disk-shaped ring. The dispenser ring 162 is a disk-shaped ring. The vial ring 161 attaches to the dispenser ring 162 to form a composite prism. The vial ring 161 is configured to screw onto a prescription vial selected from the one or more prescription vials 202. The dispenser ring 162 is configured to be grasped by the clamp station 131 such that the selected prescription vial can be manipulated by the clamp station 131.

The dispensing station 104 is the mechanical substructure of an electromechanical device. The dispensing station 104: a) withdraws a prescription vial selected from the one or more prescription vials 202; b) withdraws one or more tablets 203 of the pharmacologically active media 201; and, c) deposits the withdrawn one or more tablets 203 of the pharmacologically active media 201 into the dispensing drawer 105. The dispensing station 104 will further initially weigh the mass and optically scan the size of the one or more tablets 203 of the pharmacologically active media 201 in order to determine the physical characteristics of a tablet 203 of the pharmacologically active media 201. The dispensing station 104 comprises a clamp station 131, a cull station 132, a dole station 133, a verification station 134 and a restore station 135.

The clamp station 131 and cull station 132 are integrated elements of the dispensing station. All elements of the clamp station 131 are mounted upon the cull station 132. The cull station 132 is the element of the dispensing station that selects the prescription vial selected from the one or more prescription vials 202 from the storage rack 103 and manipulates the selected prescription vial during the dispensing process.

Figure 3:
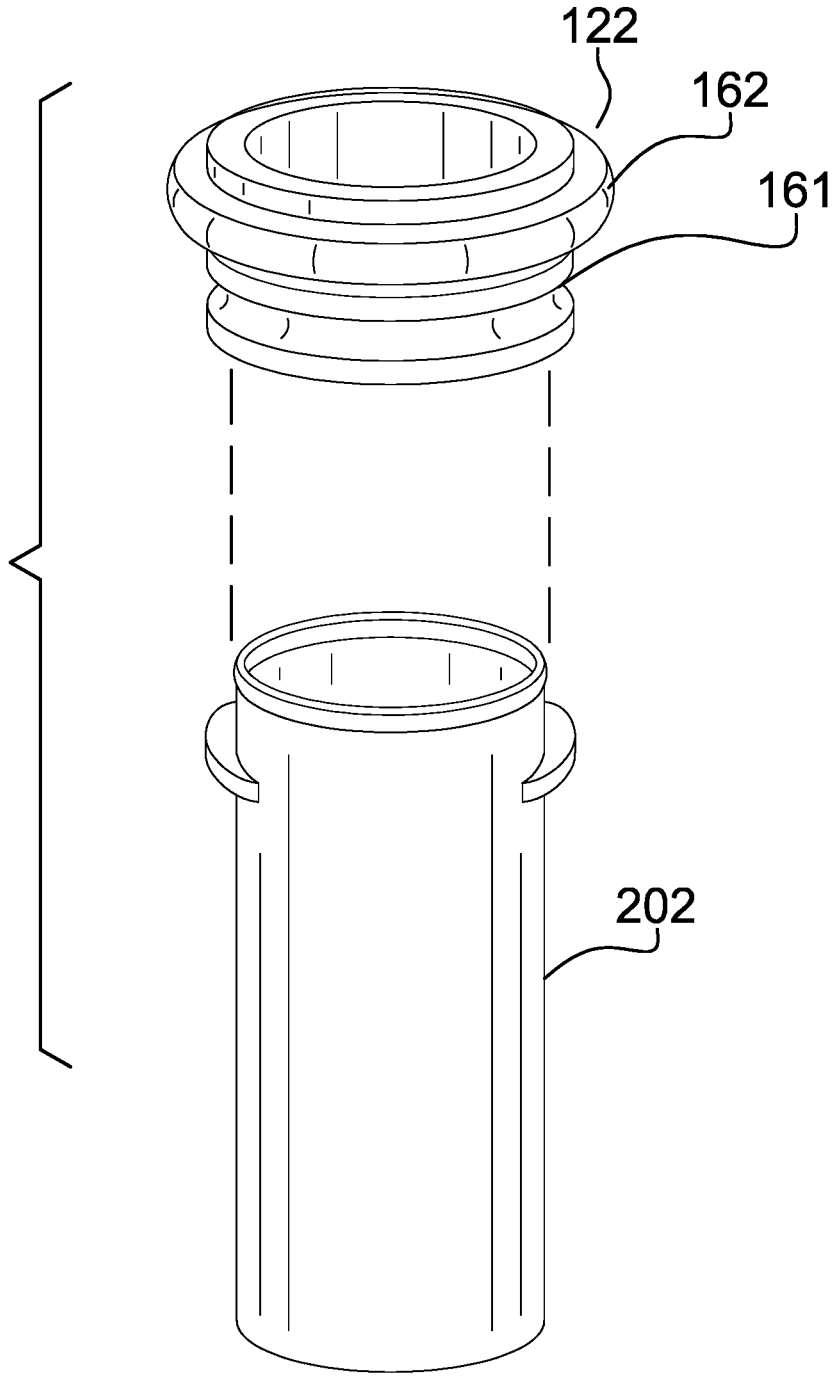
FIG. 3 is an exploded view of an embodiment of the disclosure.
Figure 4:
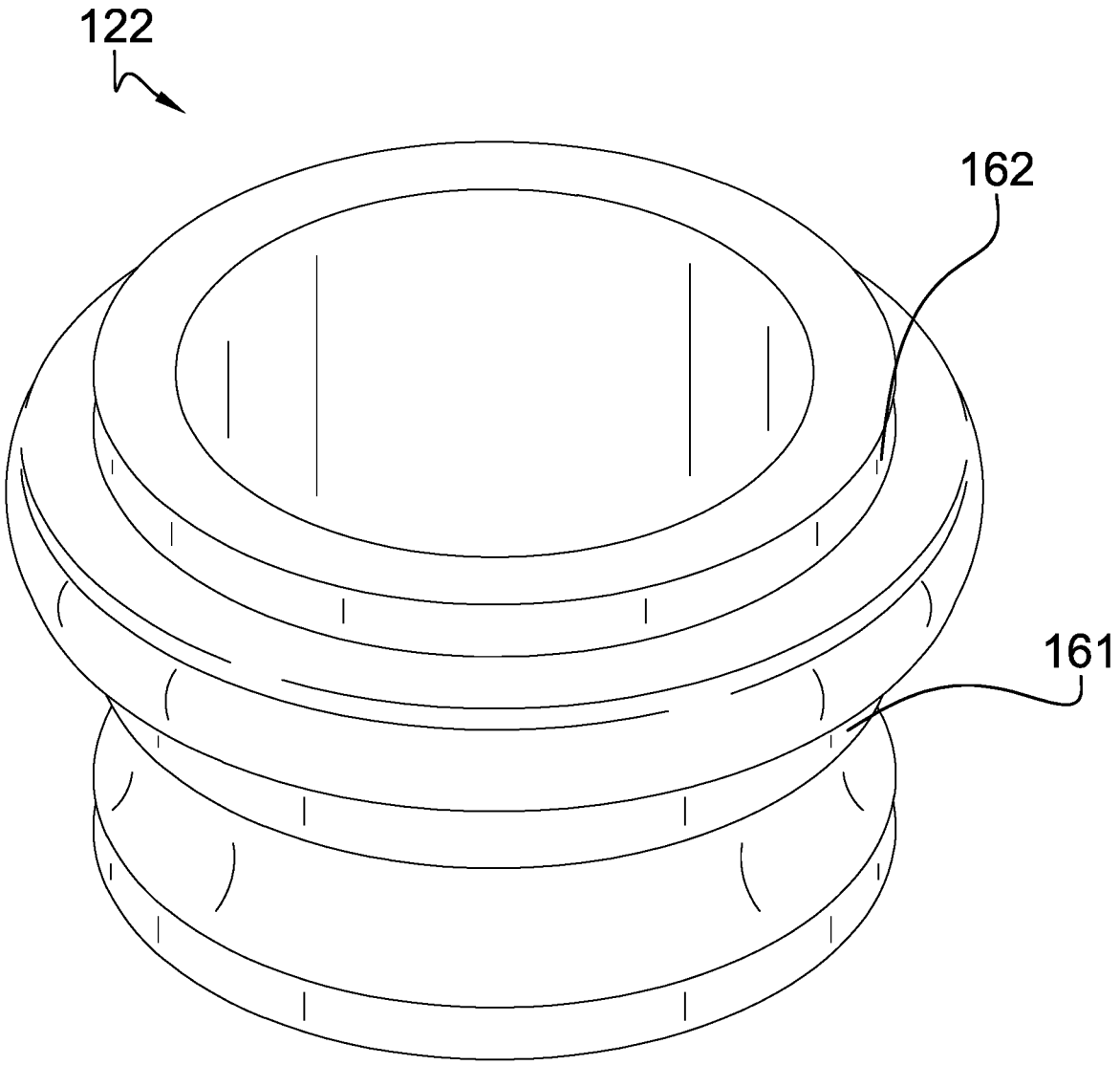
FIG. 4 is a detail view of an embodiment of the disclosure.
Figure 5:
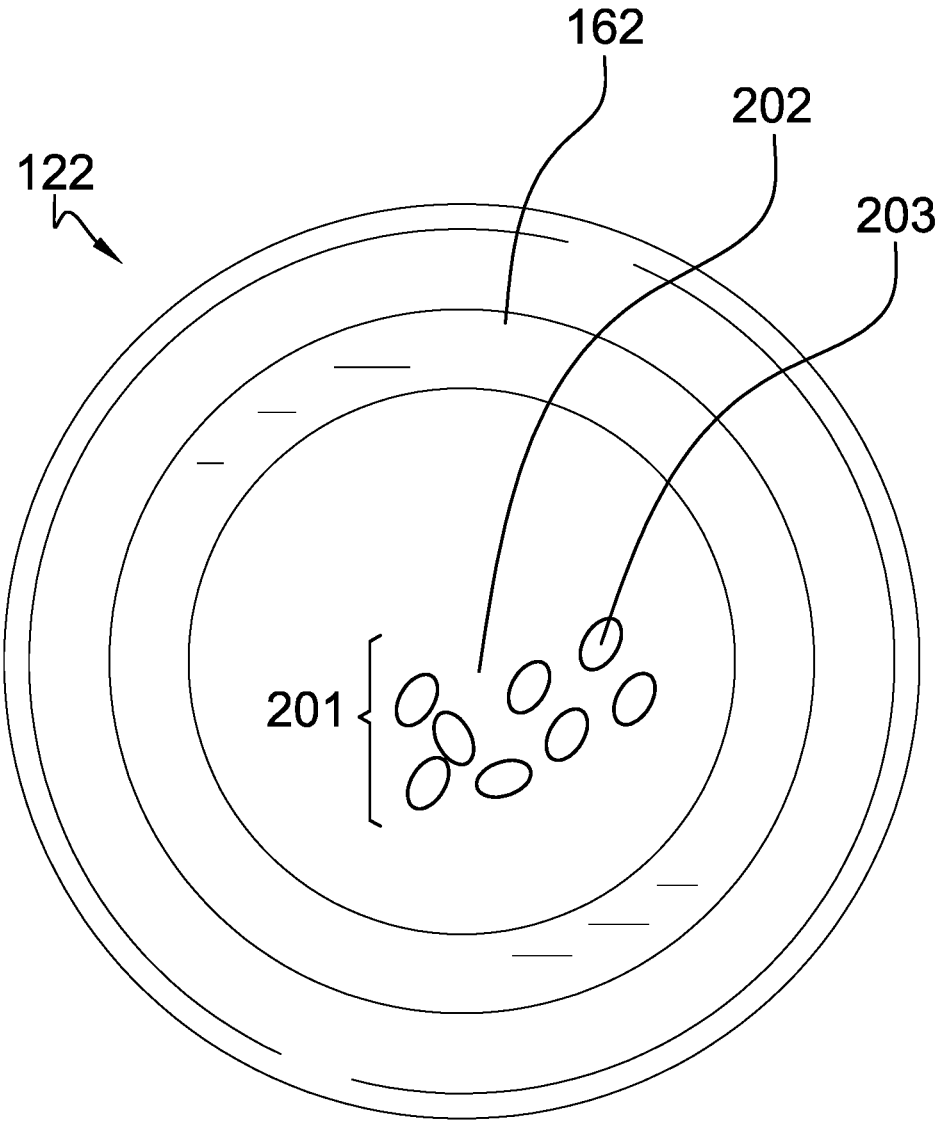
FIG. 5 is a detail view of an embodiment of the disclosure.
Figure 6:
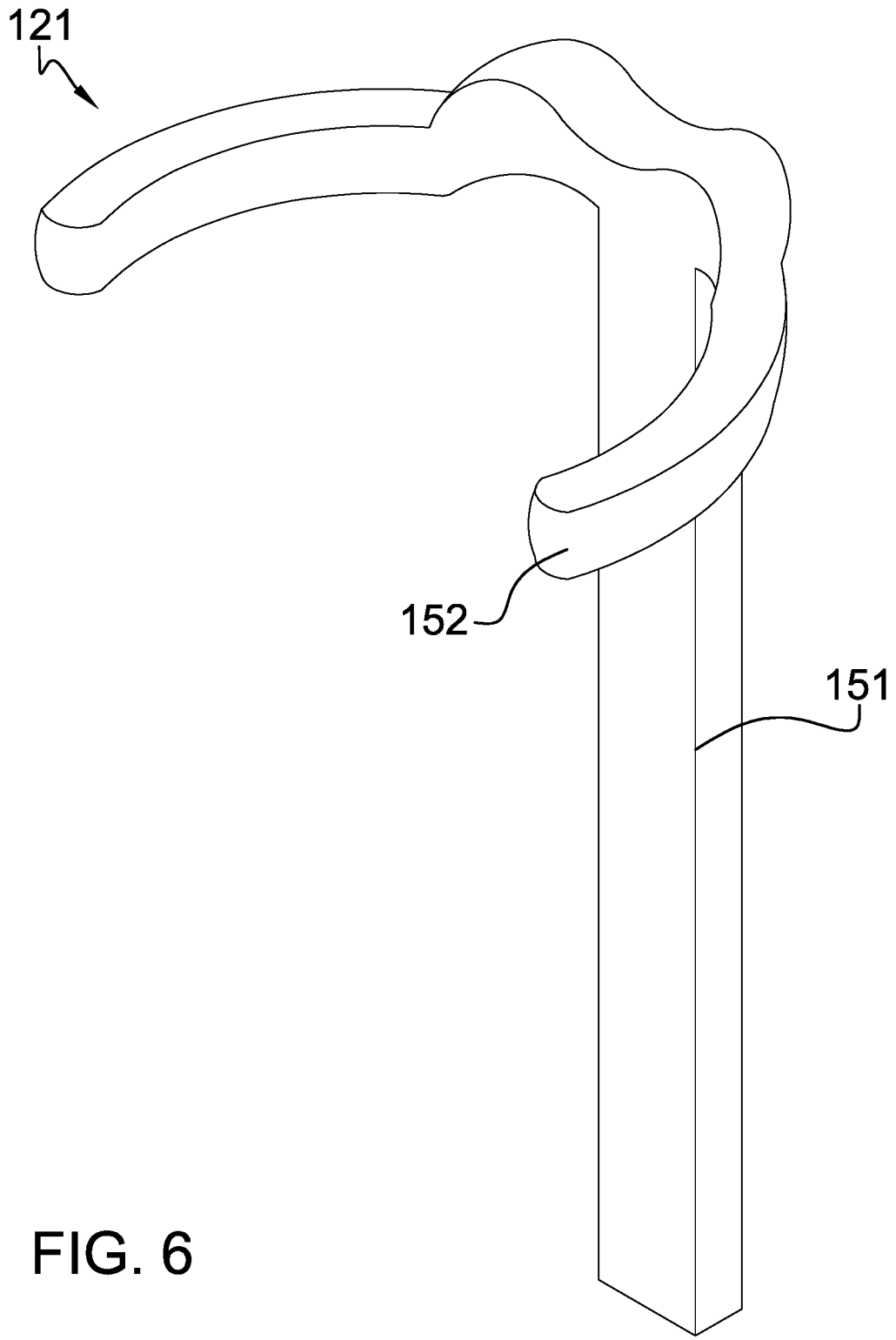
FIG. 6 is a detail view of an embodiment of the disclosure.
Figure 7:
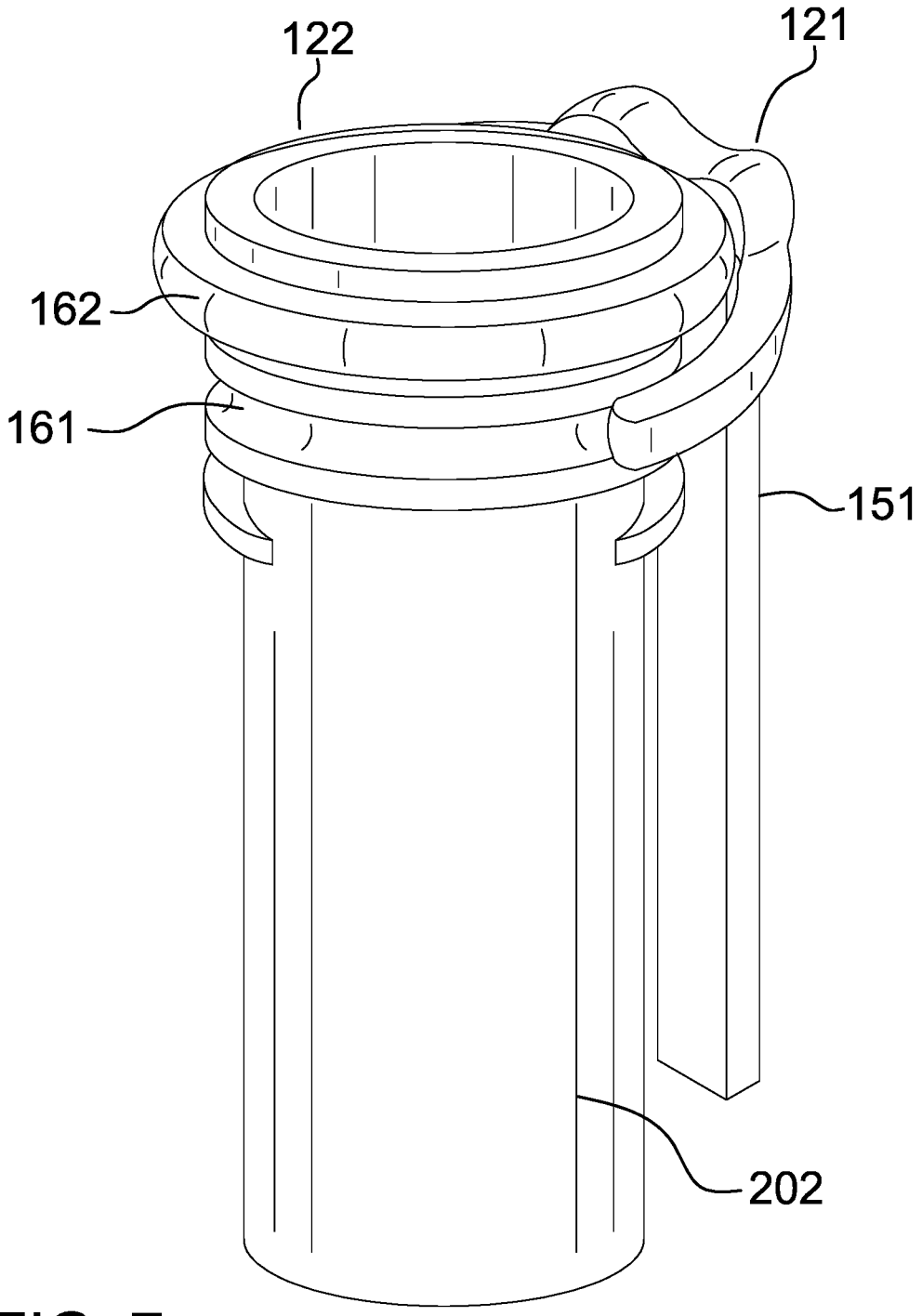
FIG. 7 is an in-use view of an embodiment of the disclosure.
Figure 8:
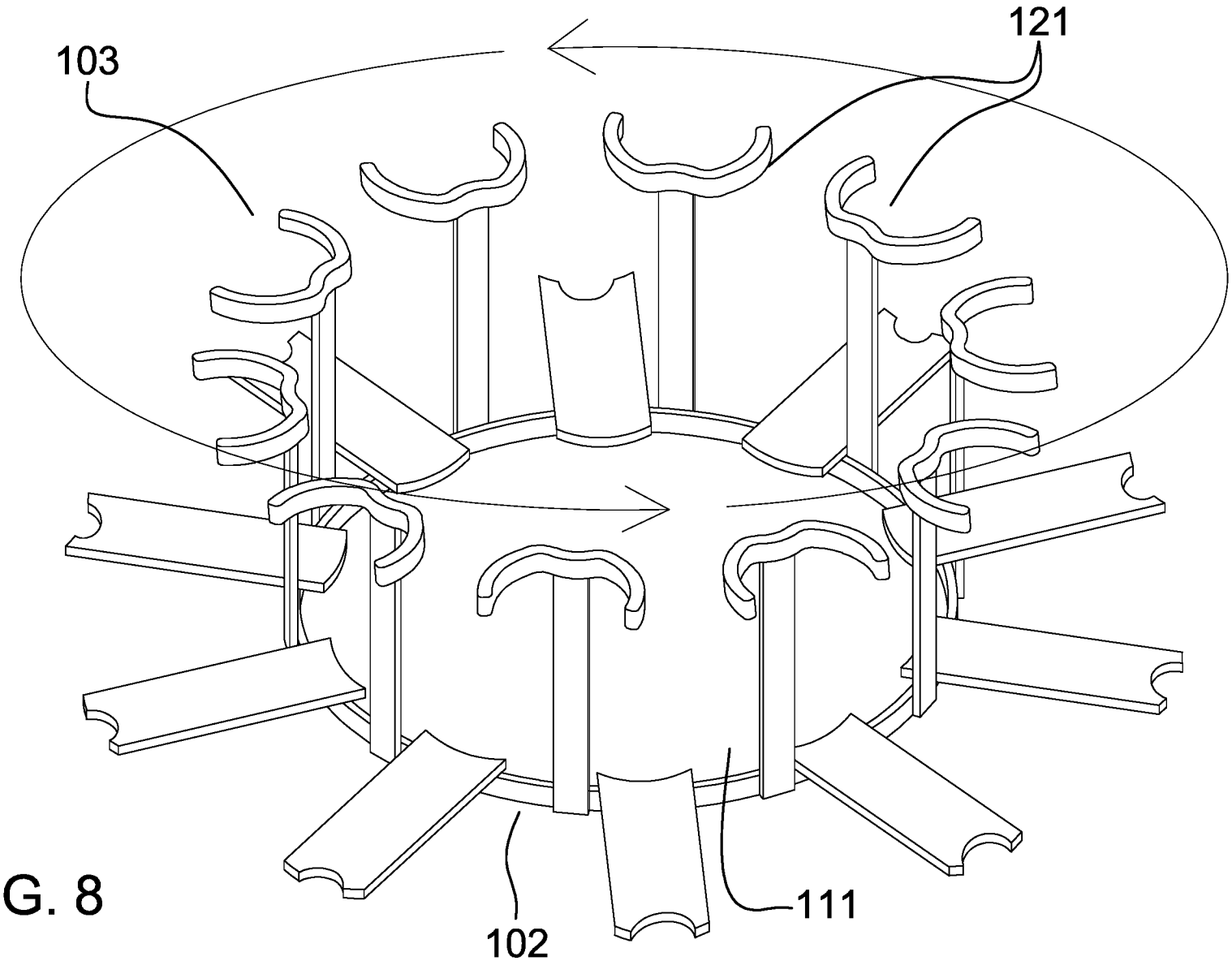
FIG. 8 is a detail view of an embodiment of the disclosure.
Figure 9:
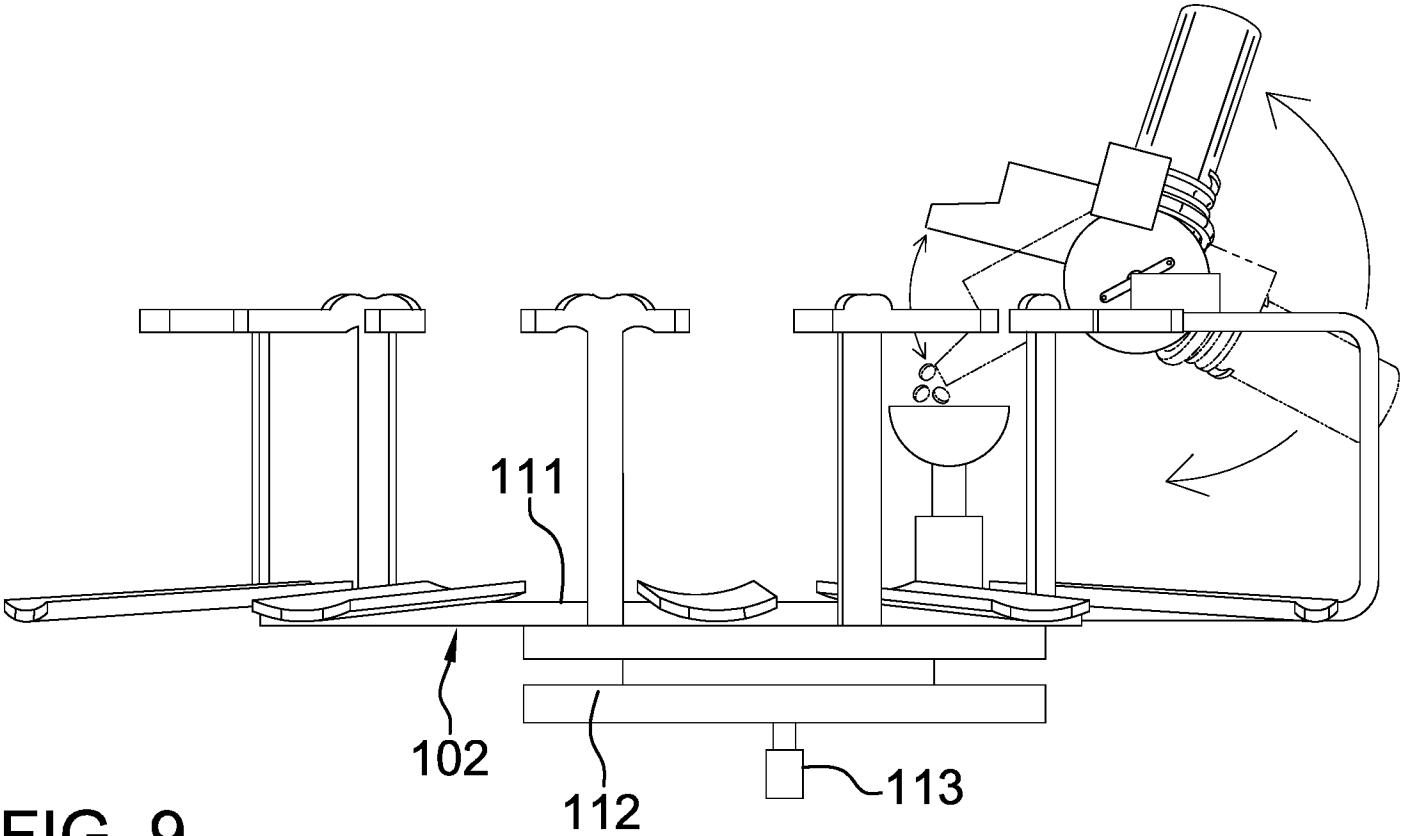
FIG. 9 is a detail view of an embodiment of the disclosure.
Figure 10:
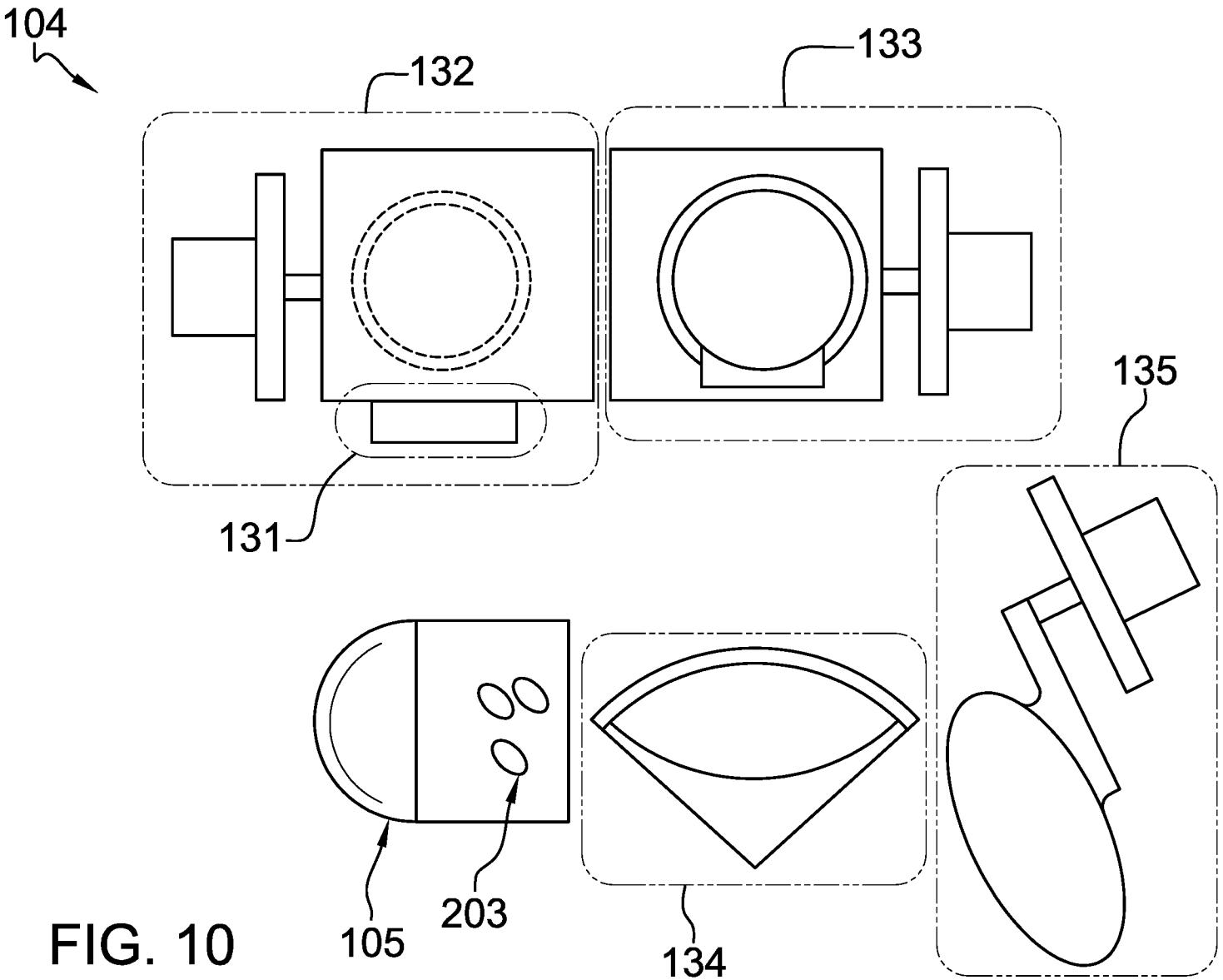
FIG. 10 is a detail plan view of an embodiment of the disclosure.
Figure 11:
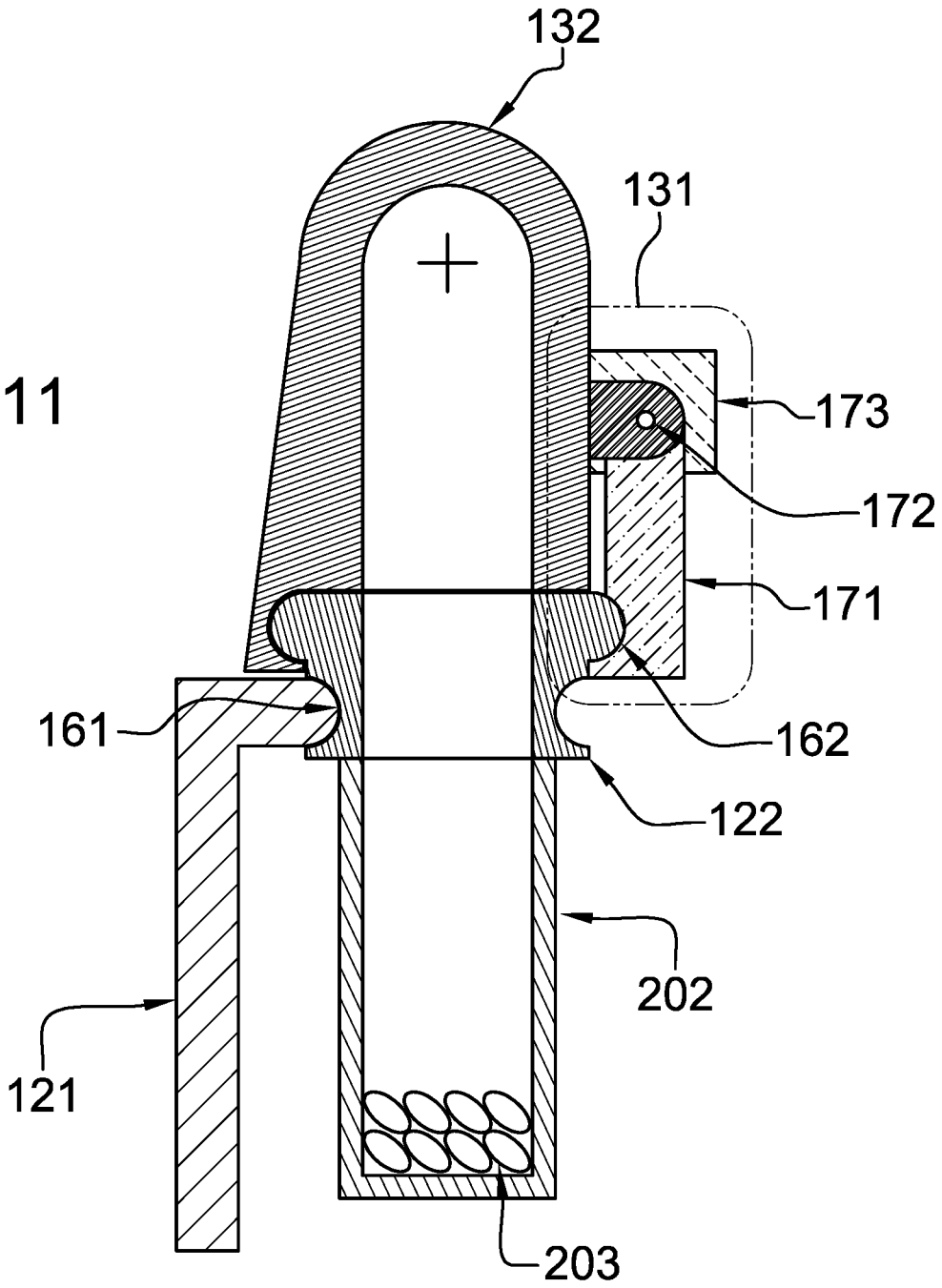
FIG. 11 is a detail cross section side view of an embodiment of the disclosure.
Figure 12:
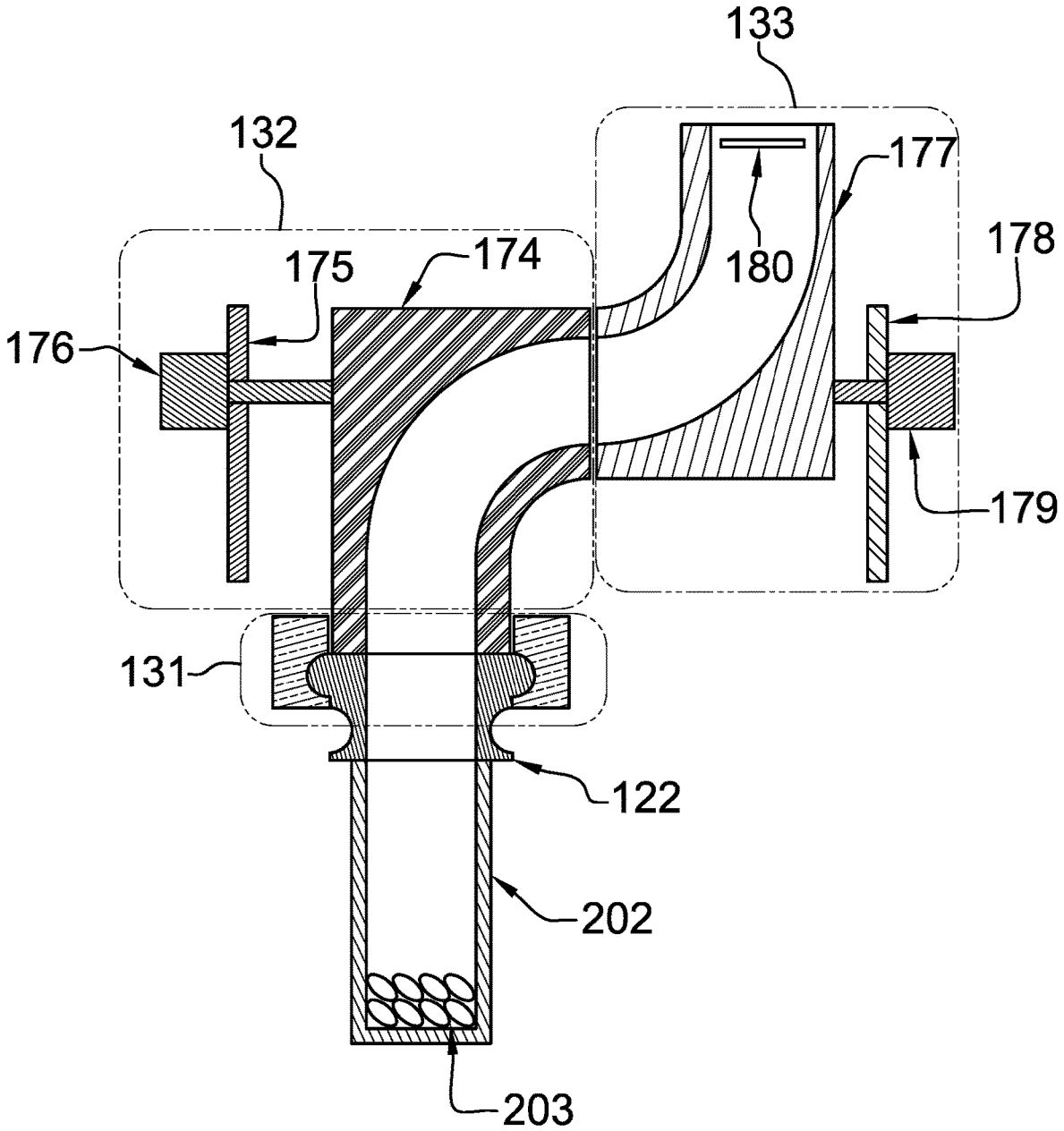
FIG. 12 is a detail cross section front view of an embodiment of the disclosure.
Figure 13:
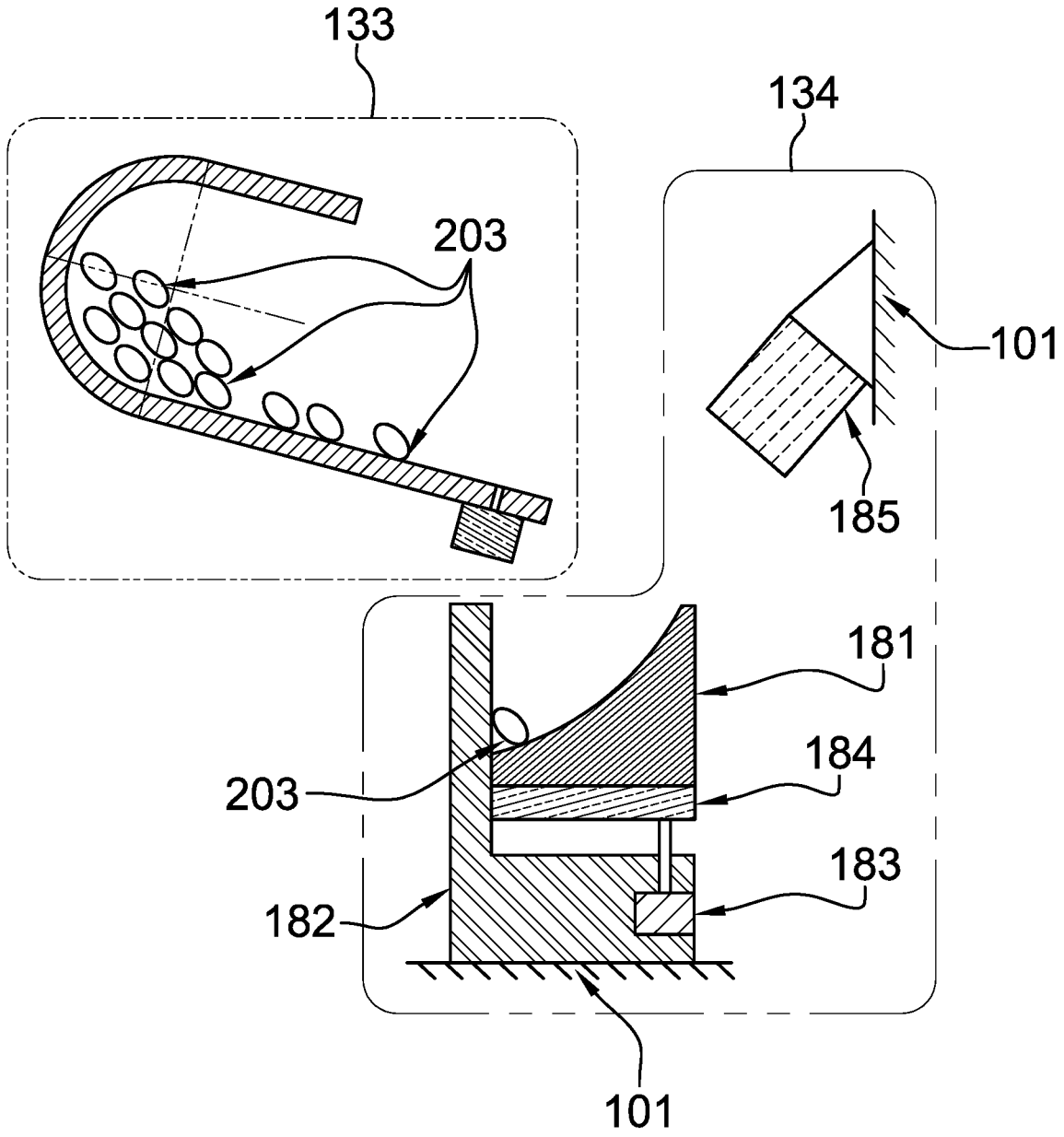
FIG. 13 is a detail cross section side view of an embodiment of the disclosure.
Figure 14:
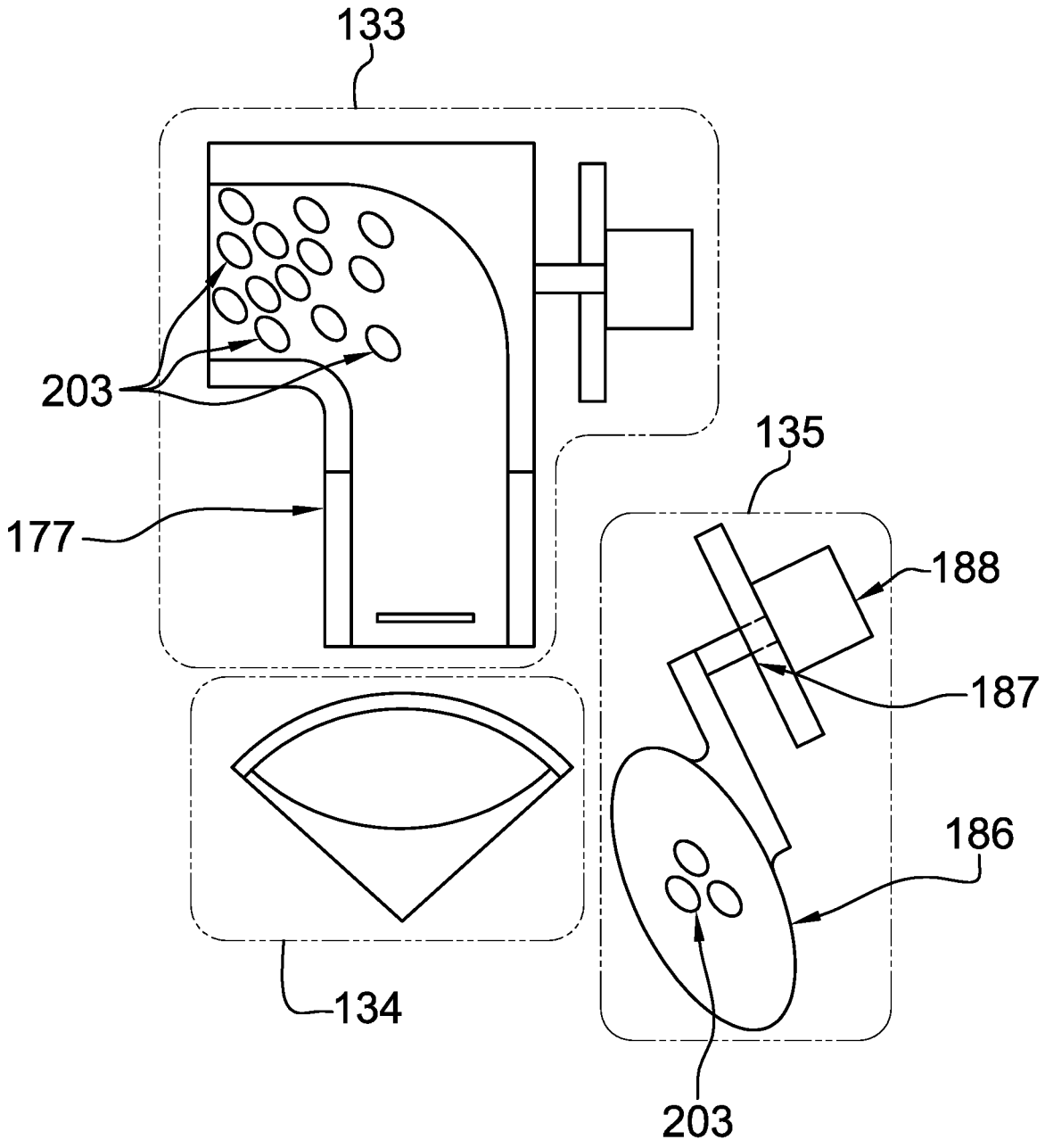
FIG. 14 is a detail plan view of an embodiment of the disclosure.
Figure 15:
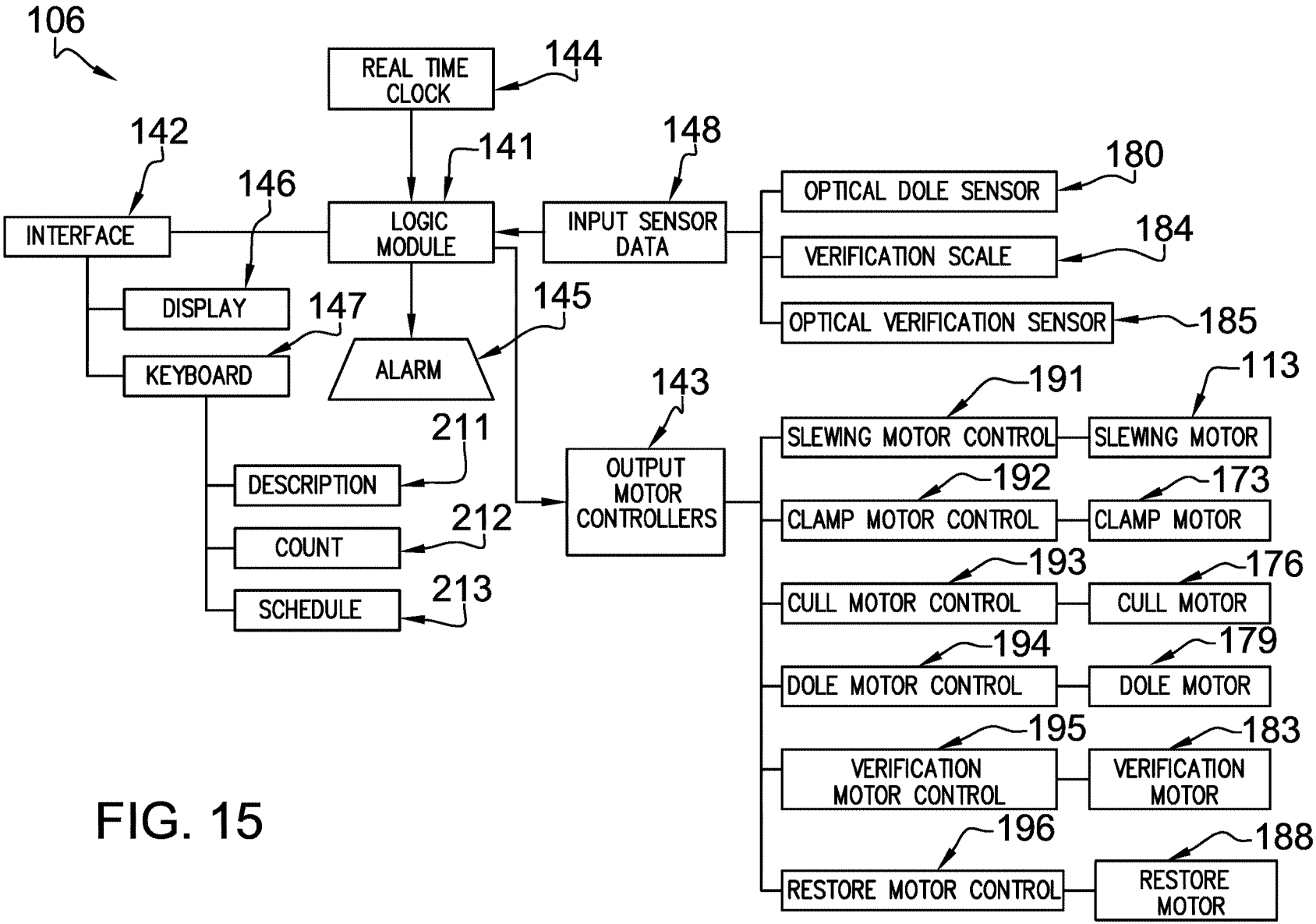
FIG. 15 is a block diagram of an embodiment of the disclosure.

The clamp station 131 must first be engaged to temporarily and rigidly attach the prescription vial 202 with lid adapter 122 subassembly FIG. 3 to the cull station 131. The clamp station comprises an adapter clamp 171, a clamp bearing 172 and a clamp motor 173. The adapter clamp 171 is a hyoid-shaped structure. When engaged, the adapter clamp 171 grasps the dispenser ring 162 of the lid adapter 122 associated with the selected prescription vial 202 such that the selected prescription vial 202 can be manipulated by the cull station 132 of the dispense station. The clamp bearing 172 is a rolling element bearing that attaches the adapter clamp 171 to the cull tube 174 such that the adapter clamp 171 can rotate freely within the clamp bearing 172. The adapter clamp 171 rotates such that the clamp function is complete when the adapter clamp 171 engages the dispenser ring 162. The clamp motor 173 is an electrical motor. The operation of the clamp motor 173 is controlled by the control system 106. The clamp motor 173 provides the rotational forces necessary to rotate the adapter clamp 171.

The cull station 132 rotates such that the angle of the selected prescription vial 202 relative to the force of gravity is adjustable. The cull station 132 comprises a cull tube 174, a cull tube bearing 175 and a cull motor 176. The cull tube 174 is a hollow "J" shaped structure. The cull tube bearing 175 is a rolling element bearing that attaches the cull tube 174 to the cabinet 101 such that the cull tube 174 can rotate freely within the cull tube bearing 175. The control system 106 controls the operation of the cull motor 176. The cull motor 176 provides the rotational forces necessary to rotate the cull tube 174. The culling function is complete when the cull tube 174 has completed approximately one-half rotation such that the prescription vial 202 is fully inverted. The cull motor 176 rotates the cull tube 174 with the selected prescription vial 202 such that gravity causes the entire contents of one or more tablets 203 of the pharmacologically active media 201 from the prescription vial 202 to fall through the cull tube 174, and into the adjacent dole station 133.

The dole station 133 is the element of the dispensing station that isolates a single tablet 203 of the pharmacologically active media 201 and delivers it into the verification station 134. The dole station comprises a dole tube 177, a dole tube bearing 178, a dole motor 179, and an optical dole sensor 180. Upon completion of the previous culling function, the contents of one or more tablets 203 of the pharmacologically active media 201 from the prescription vial 202 are located within the dole tube 177. The dole tube 177 is a hollow "J" shaped structure. The dole tube bearing 178 is a rolling element bearing that attaches the dole tube 177 to the cabinet 101 such that the dole tube 177 can rotate freely within the dole tube bearing 178. The control system 106 controls the operation of the dole motor 179. The rotation of the dole tube 177 is adjustable with relation to gravity. The dole motor 179 provides the rotational forces necessary to rotate the dole tube 177. The optical dole sensor 180 is located at the exit of the dole tube 177. The optical dole sensor 180 is monitored by the logic module 141. The optical dole sensor 180 is triggered with the exit of a tablet 203 from the dole tube 177. The logic module 141 interprets the triggered signal from the optical dole sensor 180, ceasing the doling function. The doling function is complete when the dole tube 177 rotates low enough that gravity causes a single tablet 203 to exit the dole tube 177, thus triggering the optical dole sensor 180. Once triggered, the control system 106 commands the dole tube 177 to rotate into the initial upright position. Upon exit from the dole tube 177, gravity causes the tablet 203 to enter into the verification station 134. In such cases that the dose requires more than a single tablet 203 the dispense station 104 completes its function for the first tablet, then repeats its function for additional tablets 203 in single succession.

The verification station 134 is the element of the dispensing station 104 that ensures the exact dosage of the pharmacologically active media 201 has been doled from the contents of the prescription vial 202. The logic module 141 uses input sensor data 148 to determine if the desired quantity of pharmacologically active media 201 has been doled from the previous doling function. The verification station 134 comprises a verification tray 181, a VERIFICATION bearing 182, a VERIFICATION motor 183, a verification scale 184, and an optical verification sensor 185. The verification tray 181 is a trough-shaped structure, positioned under the dole tube 177 exit such that gravity causes any doled tablet 203 to fall within. The verification tray 181 is mounted upon the verification scale 184. The verification scale 184 is mounted to the VERIFICATION bearing 182. The VERIFICATION bearing 182 is a rolling element bearing that connects the verification tray 181 to the cabinet 101 such that the verification tray 181 can rotate freely within. The control system 106 controls the operation of the VERIFICATION motor 183. The VERIFICATION motor 183 provides the rotational forces necessary to rotate the verification tray 181. The verification scale 184 is a piezoelectric sensor that electrically connects to and is monitored by the logic module 141. The verification scale 184 generates an electrical signal that is a function of the weight of the one or more tablets 203 of the pharmacologically active media 201 dispensed into the verification tray 181. The optical verification sensor 185 is affixed to the cabinet. The optical verification sensor 185 generates a digital signal that is processed by the logic module to correlate to the size of one or more tablets 203 of the pharmacologically active media 201 dispensed into the verification tray 181. The verification function utilizes the control module 106 to command the verification tray 181 to articulate in the positive direction or the negative direction depending on the success of the verification. If the logic module 141 successfully verifies the tablet 203 quantity required, then the verification tray 181 rotates positive to empty the contents into the dispensing drawer 105. If the logic module 141 determines that more than the required quantity of tablets 203 were doled, then the verification tray 181 rotates in the negative direction, emptying the contents into the restore station 135.

The restore station 135 is the element of the dispense station 104 that returns any and all tablets 203 that are erroneously doled from the contents of the prescription vial 202. This is an error correcting function. Additionally, when a new prescription vial is loaded into the storage rack 103, the dispensing station 104 performs the clamping, culling, doling, and verification functions multiple times, each time utilizing the restoring function. This initial sequence acts as a self-calibration for each new tablet 203 type. Self-calibration is performed for all newly loaded prescription vials 202 and the data collected is stored in the logic module 141. The restore station is a cantilever trough shaped structure that consists of a restore tray 186, restore bearing 187 and restore motor 188. The restore tray 186 is mounted on the restore bearing 187 such that it can be raised and lowered in a vertical arc. The restore motor 188 provides the forces necessary to articulate the structure. The restore motor 188 is controlled by the control system 106. The restore tray 186 is initially positioned such that gravity causes tablet(s) 203 from the verification station 134 to fall within. Full articulation of the restore tray 186 causes it to travel in an upward vertical arc to empty the contents back into the dole tube 177, reintegrating the doled tablets 203 with the other tablets 203 within the doling station 133.

The logic module 141 uses data from the self-calibration sequence, including verification scale 184 and optical verification sensor 185 data, to determine a statistical level of certainty for the physical characteristics of a single tablet 203. The physical characteristic data is stored in the logic module 141 and is used to compare during the dispensing sequence.

The dispensing drawer 105 is a drawer formed in the cabinet 101. The dispensing drawer 105 stores the dispensed tablets 203 in anticipation of use by a patient.

The control system 106 is an electrical substructure of an electromechanical device. The control system 106 controls the operation of the turntable 102, the storage rack 103, and the dispensing station 104. The control system 106 comprises a logic module 141, an interface 142, a plurality of motor controllers 143, a plurality of input sensor data 148, and a real time clock (RTC) 144.

The control system 106 and logic module 141 automatically determines the physical characteristic data of the contents of each new prescription vial installed in the storage rack 103 via the self-calibration sequence. The control system 106 collects from the patient the description 211, the tablet 203 count 212 and the dosing schedule 213 of the newly installed prescription vial. The control system 106 maintains the schedule for each of the plurality of prescription vials 202. The control system 106 generates a visual and/or audible alarm 145 when the time comes for a patient to consume a scheduled dose of the one or more of the plurality of pharmacologically active media 201. The control system 106 dispenses the proper dosage from each prescription vial selected from the one or more prescription vials 202 as required to comply with the dosing schedule of the patient.

The logic module 141 is a programmable electrical device. The logic module 141 controls and regulates the operation of the control system 106.

The real time clock (RTC) 144 is a timing device. The RTC 144 is initially set by the patient. The RTC 144 sends real time data to be processed by the logic module 141. The logic module 141 compares the stored scheduling data to the current time data in order to activate a dispensing sequence for one or more of the plurality of prescription vials 202 that are stored within the device. Upon completion of each scheduled dispensing sequence, the logic module 141 announces through the alarm 145 that the next scheduled dose of one or more of a pharmacologically active media 201 is available for the patient.

The interface 142 is an electrical device used to communicate with the user (patient). The logic module 141 controls the operation of the interface 142. The user (patient) enters the description 211, the tablet 203 count 212 and the dosing schedule 213 of the pharmacologically active media 201 of each new prescription vial installed in the storage rack 103. The interface 142 generates an audible alarm 145 to indicate that a dose of the pharmacologically active media 201 has been dispensed. The interface 142 comprises a display 146, a keyboard 147, and an alarm 145.

The alarm 145 is an audible speaker and/or visual indicator. The user can determine which of the audio or visual elements of the alarm 145 are active through the interface 142. The logic module 141 controls the operation of the alarm 145. The alarm 145 is a transducer that converts electrical signals generated by the logic module 141 into an audible sound or visual indicator capable of alerting the patient that a dose of a pharmacologically active media 201 has been dispensed. The display 146 is an electrical device. The display 146 visually displays operating information for use by the patient. The keyboard 147 comprises one or more electrical switches. The keyboard 147 is used to enter operating data into the control system 106 regarding the pharmacologically active media 201 stored and maintained within the invention 100.

Each of the plurality of motor controllers 143 is an electrical circuit. The logic module 141 controls each of the plurality of motor controllers 143. Each motor controller selected from the plurality of motor controllers 143 controls a motor selected from the group consisting of the slewing motor 113, the clamp motor 173, the cull motor 176, the dole motor 179, the verification motor 183, and the restore motor 188 under the direction of the logic module 141. The plurality of motor controllers 143 comprises a slewing motor 113 control circuit 191, a clamp motor 173 control circuit 192, a cull motor 176 control circuit 193, a dole motor 179 control circuit 194, a verification motor 183 control circuit 195, and a restore motor 188 control circuit 196.

The slewing motor control circuit 191 is an electrical circuit. The slewing motor control circuit 191 forms an interfacing circuit between the logic module 141 and the slewing motor 113 that allows the logic module 141 to control the operation of the slewing motor 113.

The clamp motor control circuit 192 is an electrical circuit. The clamp motor control circuit 192 forms an interfacing circuit between the logic module 141 and the clamp motor 173 that allows the logic module 141 to control the operation of the clamp motor 173.

The cull motor control circuit 193 is an electrical circuit. The cull motor control circuit 193 forms an interfacing circuit between the logic module 141 and the cull motor 176 that allows the logic module 141 to control the operation of the cull motor 176.

The dole motor control circuit 194 is an electrical circuit. The dole motor control circuit 194 forms an interfacing circuit between the logic module 141 and the dole motor 179 that allows the logic module 141 to control the operation of the dole motor 179.

The verification motor control circuit 195 is an electrical circuit. The verification motor control circuit 195 forms an interfacing circuit between the logic module 141 and the verification motor 183 that allows the logic module 141 to control the operation of the verification motor 183.

The restore motor control circuit 196 is an electrical circuit. The restore motor control circuit 196 forms an interfacing circuit between the logic module 141 and the restore motor 188 that allows the logic module 141 to control the operation of the restore motor 188.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Bearing: As used in this disclosure, a bearing is a mechanical device that: 1) guides and limits the motion of a moving component relative to a fixed component; and, 2) reduces the friction between the moving component and the fixed component. The use of bearings is well known and documented in the mechanical arts.

Cantilever: As used in this disclosure, a cantilever is a beam or other structure that projects away from an object and is supported on only one end. A cantilever is further defined with a fixed end and a free end. The fixed end is the end of the cantilever that is attached to the object. The free end is the end of the cantilever that is distal from the fixed end.

Capsule: As used in this disclosure, a capsule is a gelatin-based sheath that encases a single dose of a pharmacologically active media for oral consumption.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Control System: As used in this disclosure, a control system is a first device or system that manages and regulates the behavior or operation of a second device or system.

Correspond: As used in this disclosure, the term correspond is used as a comparison between two or more objects wherein one or more properties shared by the two or more objects match, agree, or align within acceptable manufacturing tolerances.

Cull: As used in this disclosure, the term cull is used to select from a large quantity; obtain from a variety of sources.

Database: As used in this disclosure, a database refers to: 1) a set of data that is organized and stored in a manner that allows for the search and retrieval of data from the data set; or, 2) the electronic device that stores and organizes a data set as described in the first definition.

Disk: As used in this disclosure, a disk is a prism-shaped object that is flat in appearance.

Display: As used in this disclosure, a display is a surface upon which is presented an image, potentially including, but not limited to, graphic images and text, that is interpretable by an individual viewing the projected image in a meaningful manner.

Dole: As used in this disclosure, dole is being used to describe a distribution of shares of something.

Drawer: As used in this disclosure, a drawer is a storage compartment that is designed to slide into and out of a larger object.

Electric Motor: In this disclosure, an electric motor is a machine that converts electric energy into rotational mechanical energy. An electric motor typically comprises a stator and a rotor. The stator is a stationary hollow cylindrical structure that forms a magnetic field. The rotor is a magnetically active rotating cylindrical structure that is coaxially mounted in the stator. The magnetic interactions between the rotor and the stator physically causes the rotor to rotate within the stator thereby generating rotational mechanical energy. This disclosure assumes that the power source is an externally provided source of DC electrical power. The use of DC power is not critical and AC power can be used by exchanging the DC electric motor with an AC motor that has a reversible starter winding.

Feedback: As used in this disclosure, feedback refers to a system, including engineered systems, or a subsystem further comprising an "input" and an "output" wherein the difference between the output of the engineered system or subsystem and a reference is used as, or fed back into, a portion of the input of the system or subsystem. Examples of feedback in engineered systems include, but are not limited to, a fluid level control device such as those typically used in a toilet tank, a cruise control in an automobile, a fly ball governor, a thermostat, and almost any electronic device that comprises an amplifier. Feedback systems in nature include, but are not limited to, thermal regulation in animals and blood clotting in animals (wherein the platelets involved in blood clotting release chemical to attract other platelets)

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Housing: As used in this disclosure, a housing is a rigid casing that encloses and protects one or more devices.

Hyoid: As used in this disclosure, a hyoid refers to a three-sided structure comprising a crossbeam, a first arm, and a second arm. In a hyoid, the first arm and the second arm project away from the crossbeam: 1) in the same direction; 2) at a roughly perpendicular angle to the crossbeam, and, 3) the span of the length of the first arm roughly equals the span of the length of the second arm. Hyoids generally have a U shaped appearance.

Inferior: As used in this disclosure, the term inferior refers to a directional reference that is parallel to and in the same direction as the force of gravity when an object is positioned or used normally.

Instrument: As used in this disclosure, an instrument is a device used for measuring a physical phenomenon.

Keyboard: As used in this disclosure, a keyboard is a panel that further comprises a plurality of buttons that are commonly referred to as keys. The keyboard is commonly used to operate devices including, but not limited to, logical devices and musical instruments.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Logic Module: As used in this disclosure, a logic module is a readily and commercially available electrical device that is programmable and that accepts digital and analog inputs, processes the digital and analog inputs according to previously stored instruction and provides the results of these instructions as digital or analog outputs.

Motor: As used in this disclosure, a motor refers to the method of transferring energy from an external power source into rotational mechanical energy.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Optical Sensor: As used in this disclosure an "optoelectronic device" is a light sensitive transistor that outputs an electric voltage as a function of the intensity of light exposure.

Patient: As used in this disclosure, a patient is a person who is designated to receive a medical treatment, therapy or service. The term "user" is synonymous with "patient" in the context of this disclosure. Specifically, the user may be a caregiver that undergoes the task of setting up the schedule and using the interface, while the patient is consuming the pharmacologically active media. Alternatively, the patient may perform all functions. The term patient may be extended to an animal when used within the context of the animal receiving veterinary treatment or services.

Pedestal: As used in this disclosure, a pedestal is an intermediary load-bearing structure that that transfers a load between a between two objects or structures.

Pharmacologically Active Media: As used in this disclosure, a pharmacologically active media refers to a chemical substance that has a biochemical or physiological effect on a biological organism.

Piezoelectric Effect: As used in this disclosure, the piezoelectric effect refers to a class of materials wherein a strain placed upon the material will result in a redistribution of electrons within the material in a manner that causes an electric charge. This electric charge can be measured as a voltage potential across the material. This effect can be reversed in some of these materials such that the application of an AC voltage to the material will cause a vibration within the material. A material commonly used to take advantage of the piezoelectric effect is polyvinylidene difluoride which is also known as PVDF.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Ring: As used in this disclosure, a ring is a term that is used to describe a flat or plate-like structure through which an aperture is formed. Rings are often considered loops.

Rolling Element Bearing: As used in this disclosure, a rolling element bearing comprises is a type of bearing comprising an inner race, an outer race, and a plurality of ball bearings. The plurality of ball bearings are sphere shaped. The inner race is a circular ring. The outer race is a circular ring with an inner diameter that is greater than the outer diameter of the inner race. The plurality of ball bearings are placed between the inner race and the outer race such that: 1) the inner race and the outer race are coaxially positioned; and, 2) the inner race rotates relative to the outer race. Typically, the inner race attaches to a first object, and the outer race attaches to a second object such that the first object rotates relative to the second object. Typically, a rolling element bearing is disk-shaped. A rolling element bearing is said to be "locking" when the relative position of the inner race can be locked into a fixed position relative to the outer race. Rolling element bearings, including locking versions, are: 1) commercially available; and, 2) well-known and documented in the mechanical arts.

Scale: As used in this disclosure, a scale is an instrument used to measure the weight or mass of an object.

Servo Motor: As used in this disclosure, a servo motor is an electrical motor that further incorporates a feedback circuit that allows for the precise angular positioning of the electric motor.

Shell: As used in this disclosure, a shell is a structure that forms an outer covering intended to contain an object. Shells are often, but not necessarily, rigid or semi-rigid structures that are intended to protect the object contained within it.

Slew: As used in this disclosure, to slew means to turn or rotate an object around a fixed point or axis.

Slewing Bearing: As used in this disclosure, a slewing bearing is a device that is used to rotate an object on a horizontal surface. Slewing bearings are often called turntable bearings or a lazy Susan bearing.

Superior: As used in this disclosure, the term superior refers to a directional reference that is parallel to and in the opposite direction of the force of gravity when an object is positioned or used normally.

Suspend: As used in this disclosure, to suspend an object means to support an object such that the inferior end of the object does not form a significant portion of the load path of the object. Include inferior superior and load path.

Tablet: As used in this disclosure, a tablet is a delivery method that comprises an active chemical compound. A tablet may further comprise auxiliary chemical compounds that perform a variety of functions including supplementing the stability and providing additional bulk for the active chemical compound. The tablet form of an active chemical compound and the auxiliary chemical compounds is of a power that is compressed into a single object that is generally taken orally. A tablet is generally formulated to provide a measured dose of the active chemical compound. A tablet is often referred to as a pill.

Timing Device: As used in this disclosure, a timing device is an automatic mechanism for activating or deactivating a device at a specific time or after a specific period of time. This disclosure assumes that the logic module is provisioned with a timing device.

Trough: As used in this disclosure, a trough refers to a three-sided structure comprising a cross-plate, a first plate, and a second plate. In a trough, the first plate and the second plate project away from the cross-plate: 1) in the same direction; 2) at a roughly perpendicular angle to the cross-beam, and, 3) the span of the length of the first plate roughly equals the span of the length of the second plate. Troughs generally have a hyoid shaped appearance. A gutter is an example of a trough.

Verification: As used in this disclosure, verification refers to the process of establishing the truth, accuracy, or validity of something.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 15 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A medical distribution device comprising:

a cabinet, a turntable, a storage rack, a dispensing station, a dispensing drawer, and a control system;

wherein the cabinet contains the turntable, the storage rack, the dispensing station, the dispensing drawer, and the control system;

wherein the medical distribution device is configured for use with one or more prescription vials that contain a pharmacologically active media in the form of a tablet or a capsule;

wherein the pharmacologically active media is contained within a prescription vial selected from the one or more prescription vials;

wherein the medical distribution device dispenses the dosage of pharmacologically active media to a patient;

wherein the medical distribution device maintains a database regarding each of the plurality of prescription vials;

wherein the medical distribution device calculates and measures the time between doses of any two pharmacologically active media contained in any two prescription vials selected from the one or more prescription vials;

wherein the medical distribution device generates an alarm when a dose of a pharmacologically active media selected from the one or more prescription vials is due to be consumed by the patient;

wherein the medical distribution device counts out the one or more tablets necessary to provide the dose;

wherein the control system manages and regulates the operation of the medical distribution device;

wherein the turntable and the storage rack stores the one or more prescription vials;

wherein the dispensing station and the dispensing drawer count and dispense one or more doses of pharmacologically active media that are required by a patient;

wherein the cabinet is a hollow shell;

wherein the turntable is a rotating structure;

wherein the turntable forms a rotating horizontal surface upon which the storage rack mounts;

wherein the storage rack is a mechanical structure;

wherein the storage rack stores the one or more prescription vials such that each of the one or more prescription vials is accessible to the dispensing station;

wherein the dispensing station is a mechanical substructure of an electromechanical device;

wherein the dispensing station withdraws a prescription vial selected from the one or more prescription vials;

withdraws one or more tablets of the pharmacologically active media;

deposits the withdrawn one or more tablets of the pharmacologically active media into the dispensing drawer;

wherein the dispensing station measures the weight of the one or more tablets of the pharmacologically active media in order to determine the weight of a tablet of the pharmacologically active media;

wherein the dispensing drawer is a drawer formed in the cabinet;

wherein the dispensing drawer stores the dispensed tablets in anticipation of use;

wherein the control system is an electrical substructure of the electromechanical device;

wherein the control system generates an audible and/or visual alarm when the time comes for a patient to consume a dose of the pharmacologically active media;

wherein the control system dispenses the proper dosage from each prescription vial selected from the one or more prescription vials;

wherein the control system weighs and optically scans the contents of a new prescription vial installed in the storage rack;

wherein the control system collects a description, a tablet count and a dosing schedule of each installed prescription vial.

2. The medical distribution device according to claim 1 wherein the turntable comprises a slewing platform, a slewing bearing, and a slewing motor;

wherein the slewing platform attaches to the slewing bearing;

wherein the slewing motor attaches to the slewing bearing;

wherein the slewing platform is a disk-shaped horizontal surface;

wherein the slewing bearing attaches the slewing platform to the cabinet.

3. The medical distribution device according to claim 2 wherein the slewing motor is an electrical motor;

wherein the slewing motor is controlled by the control system;

wherein the storage rack mounts on the turntable such that the rotation of the turntable changes the position of the storage rack relative to the dispensing station.

4. The medical distribution device according to claim 3 wherein the storage rack comprises a plurality of bottle stations and a plurality of lid adapters;

wherein each of the plurality of bottle stations is a mechanical structure;

wherein each of the plurality of lid adapters attaches a prescription vial selected from the one or more prescription vials to the bottle station;

wherein each of the plurality of bottle stations suspends the prescription vial selected from the one or more prescription vials above the slewing platform of the turntable;

wherein each of the plurality of bottle stations is identical;

wherein each of the plurality of lid adapters is a composite prism structure;

wherein each of the plurality of lid adapters attaches to a prescription vial selected from the one or more prescription vials;

wherein each of the plurality of lid adapters attaches to a selected prescription vial such that the selected prescription vial is suspended from the plurality of bottle stations;

wherein each of the plurality of lid adapters attaches to a selected prescription vial such that the selected prescription vial can be accessed and manipulated by the dispensing station.

5. The medical distribution device according to claim 4 wherein each of the plurality of bottle stations comprises a vial stanchion and a vial clamp;

wherein the vial clamp attaches to the vial stanchion.

6. The medical distribution device according to claim 5 wherein the vial stanchion is an extension structure that creates a vertical span of distance between the superior surface of the slewing platform and the vial clamp;

wherein the vial stanchion is a stanchion that projects perpendicularly away from the superior surface of the slewing platform in the manner of a cantilever.

7. The medical distribution device according to claim 6 wherein the vial clamp is a hyoid-shaped structure;

wherein the vial clamp attaches to the free end of the vial stanchion such that the selected prescription vial is suspended above the superior surface of the slewing platform;

wherein the vial clamp is configured to grasp the vial ring of a lid adapter selected from the plurality of lid adapters such that the selected prescription vial associated with the selected lid adapter is suspended above the slewing platform by the vial stanchion.

8. The medical distribution device according to claim 7 wherein each of the plurality of lid adapters comprises a vial ring and a dispenser ring;

wherein the vial ring is a disk-shaped ring;

wherein the dispenser ring is a disk-shaped ring;

wherein the vial ring attaches to the dispenser ring to form a composite prism.

9. The medical distribution device according to claim 8 wherein the vial ring is configured to screw onto a prescription vial selected from the one or more prescription vials;

wherein the dispenser ring is configured to be grasped by the clamp station such that the selected prescription vial is manipulated by the clamp station.

10. The medical distribution device according to claim 9 wherein the dispensing station comprises a clamp station, a cull station, a dole station, a verification station, and a restore station;

wherein the clamp station is mounted upon the cull station;

wherein the cull station is the element of the dispensing station that selects the prescription vial selected from the one or more prescription vials from the storage rack and manipulates the selected prescription vial during the dispensing process.

11. The medical distribution device according to claim 10 wherein the clamp station comprises an adapter clamp, a clamp bearing, and a clamp motor;

wherein the adapter clamp grasps the dispenser ring of the lid adapter associated with the selected prescription vial such that the selected prescription vial is manipulated by the cull station of the dispense station;

wherein the clamp bearing is a rolling element bearing that attaches the adapter clamp to the cull tube such that the adapter clamp rotates freely within the clamp bearing;

wherein the adapter clamp rotates such that the clamp function is complete when the adapter clamp engages the dispenser ring;

wherein the clamp motor is controlled by the control system;

wherein the clamp motor provides the rotational forces necessary to rotate the adapter clamp;

wherein the cull station comprises a cull tube, a cull tube bearing and a cull motor;

wherein the cull tube is a hollow "J" shaped structure;

wherein the cull tube bearing is a rolling element bearing that attaches the cull tube to the cabinet such that the cull tube rotates freely within the cull tube bearing;

wherein the control system controls the operation of the cull motor;

wherein the cull motor provides the rotational forces necessary to rotate the cull tube;

wherein the cull motor rotates the cull tube with the selected prescription vial such that gravity causes the entire contents of one or more tablets of the pharmacologically active media from the prescription vial to fall through the cull tube, and into the adjacent dole station.

12. The medical distribution device according to claim 11 wherein the dole station isolates and delivers a single tablet of the pharmacologically active media into the verification station;

wherein the dole station comprises a dole tube, a dole tube bearing, a dole motor, and an optical dole sensor;

wherein the contents of one or more tablets of the pharmacologically active media from the prescription vial are located within the dole tube;

wherein the dole tube is a hollow "J" shaped structure;

wherein the dole tube bearing is a rolling element bearing that attaches the dole tube to the cabinet such that the dole tube rotates freely within the dole tube bearing;

wherein the control system controls the operation of the dole motor;

wherein the dole motor provides the rotational forces necessary to rotate the dole tube;

wherein the optical dole sensor is located at the exit of the dole tube;

wherein the optical dole sensor is monitored by the logic module;

wherein the optical dole sensor is triggered with the exit of said tablet from the dole tube;

wherein the logic module interprets the triggered signal from the optical dole sensor, ceasing the doling function;

wherein the verification station ensures the exact dosage of the pharmacologically active media has been doled from the contents of the prescription vial;

wherein the logic module uses input sensor data to determine if the desired quantity of pharmacologically active media has been doled from the previous doling function;

wherein the verification station comprises a verification tray, a verification bearing, a verification motor, a verification scale, and an optical verification sensor;

wherein the verification tray is a trough-shaped structure, positioned under the dole tube exit such that gravity causes any doled tablet to fall within;

wherein the verification tray is mounted upon the verification scale;

wherein the verification scale is mounted to the verification bearing;

wherein the verification bearing is a rolling element bearing that connects the verification tray to the cabinet such that the verification tray rotates freely within;

wherein the control system controls the operation of the motor;

wherein the verification motor provides the rotational forces necessary to rotate the verification tray;

wherein the verification scale is a piezoelectric sensor that electrically connects to and is monitored by the logic module;

wherein the verification scale generates an electrical signal that is a function of the weight of the one or more tablets of the pharmacologically active media dispensed into the verification tray;

wherein the optical verification sensor is affixed to the cabinet;

wherein the optical verification sensor generates a digital signal that is processed by the logic module to correlate to the size of one or more tablets of the pharmacologically active media dispensed into the verification tray;

wherein the verification function utilizes the control module to command the verification tray to articulate in the positive direction or the negative direction depending on the success of the verification.

13. The medical distribution device according to claim 12 wherein the restore station is the element of the dispense station that returns any and all tablets that are erroneously doled from the contents of the prescription vial;

wherein the restore station is a cantilever trough shaped structure that consists of a restore tray, restore bearing and restore motor;

wherein the restore tray is mounted on the restore bearing such that it can be raised and lowered in a vertical arc;

wherein the restore motor provides the forces necessary to articulate the structure;

wherein the restore motor is controlled by the control system;

wherein the restore tray is initially positioned such that gravity causes tablet(s) from the verification station to fall within;

wherein the dispensing drawer is a drawer formed in the cabinet;

wherein the dispensing drawer stores the dispensed tablets.

14. The medical distribution device according to claim 13 wherein the control system is an electrical substructure of an electromechanical device;

wherein the control system controls the operation of the turntable and the storage rack;

wherein the control system comprises the logic module, an interface, a plurality of motor controllers, a plurality of input sensor data, and a real time clock;

wherein the control system and logic module automatically determines the physical characteristic data of the contents of each new prescription vial installed in the storage rack via the self-calibration sequence;

wherein the control system generates a visual and audible alarm when the time comes for a patient to consume a scheduled dose of the one or more of the plurality of pharmacologically active media;

wherein the real time clock is a timing device that sends real time data to be processed by the logic module;

wherein the logic module controls the operation of the interface;

wherein the interface generates an audible and/or visual alarm to indicate that a dose of the pharmacologically active media has been dispensed;

wherein the interface comprises a display, a keyboard, and an alarm;

wherein the alarm is an audible speaker and/or visual indicator;

wherein the logic module controls the operation of the alarm;

wherein the alarm is a transducer that converts electrical signals generated by the logic module into an audible sound or visual indicator capable of alerting that a dose of a pharmacologically active media has been dispensed;

wherein the display visually displays operating information for use by the patient;

wherein each of the plurality of motor controllers is an electrical circuit;

wherein the logic module controls each of the plurality of motor controllers;

wherein each motor controller selected from the plurality of motor controllers controls a motor selected from the group consisting of the slewing motor, the clamp motor, the cull motor, the dole motor, the verification motor, and the restore motor under the direction of the logic module;

wherein the plurality of motor controllers comprises a slewing motor control circuit, a clamp motor control circuit, a cull motor control circuit, a dole motor control circuit, a verification motor control circuit, and a restore motor control circuit.

15. The medical distribution device according to claim 14 wherein the slewing motor control circuit forms an interfacing circuit between the logic module and the slewing motor that allows the logic module to control the operation of the slewing motor;

wherein the clamp motor control circuit forms an interfacing circuit between the logic module and the clamp motor that allows the logic module to control the operation of the clamp motor;

wherein the cull motor control circuit forms an interfacing circuit between the logic module and the cull motor that allows the logic module to control the operation of the cull motor;

wherein the dole motor control circuit forms an interfacing circuit between the logic module and the dole motor that allows the logic module to control the operation of the dole motor;

wherein the verification motor control circuit forms an interfacing circuit between the logic module and the verification motor that allows the logic module to control the operation of the verification motor;

wherein the restore motor control circuit forms an interfacing circuit between the logic module and the restore motor that allows the logic module to control the operation of the restore motor.

* * * * *